US008210399B2

(12) United States Patent
Olson et al.

(10) Patent No.: US 8,210,399 B2
(45) Date of Patent: Jul. 3, 2012

(54) SPRAY DISPENSER

(75) Inventors: Kerstin M. Olson, Omaha, NE (US); Harry F. Bogen, Danville, IL (US); Edmund Farmer, Seymour, CT (US); Troy Starkey, North Haven, CT (US); John K. Clay, Milford, CT (US)

(73) Assignee: ConAgra Foods RDM, Inc., Omaha, NE (US)

( * ) Notice: Subject to any disclaimer, the term of this patent is extended or adjusted under 35 U.S.C. 154(b) by 886 days.

(21) Appl. No.: 12/277,946

(22) Filed: Nov. 25, 2008

(65) Prior Publication Data

US 2009/0140011 A1 Jun. 4, 2009

Related U.S. Application Data

(60) Provisional application No. 60/990,548, filed on Nov. 27, 2007.

(51) Int. Cl.
*B67D 7/58* (2010.01)

(52) U.S. Cl. ..... 222/380; 222/402.15

(58) Field of Classification Search ..... 222/380, 222/391, 383, 1, 180, 181.1–181.3, 628, 222/185.1, 186, 401, 402, 402.2, 402.13, 222/402.15, 402.1

See application file for complete search history.

(56) References Cited

U.S. PATENT DOCUMENTS

| | | | | |
|---|---|---|---|---|
| 4,142,003 | A | 2/1979 | Sejpal | |
| 4,155,770 | A | 5/1979 | Doumani | |
| 4,345,718 | A | 8/1982 | Horvath | |
| 5,088,649 | A | 2/1992 | Hanson et al. | |
| 5,296,021 | A * | 3/1994 | Clapp et al. | 106/2 |
| 5,455,055 | A | 10/1995 | Stoltz | |
| 5,638,994 | A | 6/1997 | Libit et al. | |
| 6,210,743 | B1 * | 4/2001 | Clapp et al. | 426/662 |
| 6,474,510 | B2 * | 11/2002 | Frutin | 222/153.11 |
| 6,799,701 | B2 * | 10/2004 | Weiperth | 222/158 |
| 7,455,199 | B2 * | 11/2008 | Cockings et al. | 222/402.1 |
| 2004/0222246 | A1 * | 11/2004 | Bates et al. | 222/402.15 |

* cited by examiner

*Primary Examiner* — Lien Ngo
(74) *Attorney, Agent, or Firm* — Advent; Ryan T. Grace

(57) ABSTRACT

A dispenser includes a housing having a sidewall with first and second axial ends. A container has first and second end portions with the second end portion engaged with the housing such that the container extends from the first axial end of the housing. A plunger having first and second sides is disposed in the interior cavity of the container. The interior cavity of the container and the first side of the base cooperatively define a product cavity. The interior cavity of the container and the second side of the base cooperatively define an air cavity. A valve mechanism is in engagement with the second end portion of the container. The valve mechanism includes a nozzle defining an orifice and an accumulator defining a pumping chamber. The pumping chamber is adapted to receive a portion of the product in the container. A piston is selectively slidable in the pumping chamber.

29 Claims, 5 Drawing Sheets

SPRAY DISPENSER

CROSS REFERENCE TO RELATED APPLICATION

This application claims priority to U.S. Patent Application Ser. No. 60/990,548 filed on Nov. 27, 2007 and entitled "Spray Dispenser."

BACKGROUND

Dispensing devices are used to dispense a variety of products. Many dispensers use an aerosol propellant to dispense product from the dispensers. However, there is a desire for a dispensing device having desired spray characteristics that discharges a non-propellant product.

SUMMARY

An aspect of the present disclosure relates to a dispenser. The dispenser includes a housing having a sidewall with a first axial end and a second axial end. A container has a first end portion and a second end portion with the second end portion engaged with the housing such that the container extends from the first axial end of the housing. The container defines an interior cavity adapted for containing a product. A plunger is disposed in the interior cavity of the container. The plunger includes a base having a first side and a second side. The interior cavity of the container and the first side of the base cooperatively define a product cavity. The interior cavity of the container and the second side of the base cooperatively define an air cavity. A valve mechanism is in engagement with the second end portion of the container. The valve mechanism includes a nozzle defining an orifice and an accumulator defining a pumping chamber. The pumping chamber is adapted to receive a portion of the product in the container. A piston is selectively slidable in the pumping chamber. The displacement of the piston in one direction increases a pressure of the portion of the product in the pumping chamber to a dispensing pressure.

Another aspect of the present disclosure relates to a dispenser. The dispenser includes a housing having a sidewall with a first axial end and a second axial end. A container has a first end portion and a second end portion with the second end portion engaged with the housing such that the container extends from the first axial end of the housing. The container defines an interior cavity adapted for containing a product. The product is a non-propellant cooking spray composition comprising an edible oil or mixture of edible oils, a pan release agent and a thinning agent. The composition comprises by weight about 60% to about 99% edible oil or mixture of edible oils, about 0% to about 15% thinning agent, and about 1% to about 15% pan release agent. A plunger is disposed in the interior cavity of the container. The plunger includes a base having a first side and a second side. The interior cavity of the container and the first side of the base cooperatively define a product cavity. The interior cavity of the container and the second side of the base cooperatively define an air cavity. A valve mechanism is in engagement with the second end portion of the container. The valve mechanism includes a nozzle defining an orifice and an accumulator defining a pumping chamber. The pumping chamber is adapted to receive a portion of the product in the container. A piston is selectively slidable in the pumping chamber. The displacement of the piston in one direction increases a pressure of the portion of the product in the pumping chamber to a dispensing pressure.

DETAILED DESCRIPTION

Reference will now be made in detail to the exemplary aspects of the present disclosure that are illustrated in the accompanying drawings. Wherever possible, the same reference numbers will be used throughout the drawings to refer to the same or like structure.

Figure 1:
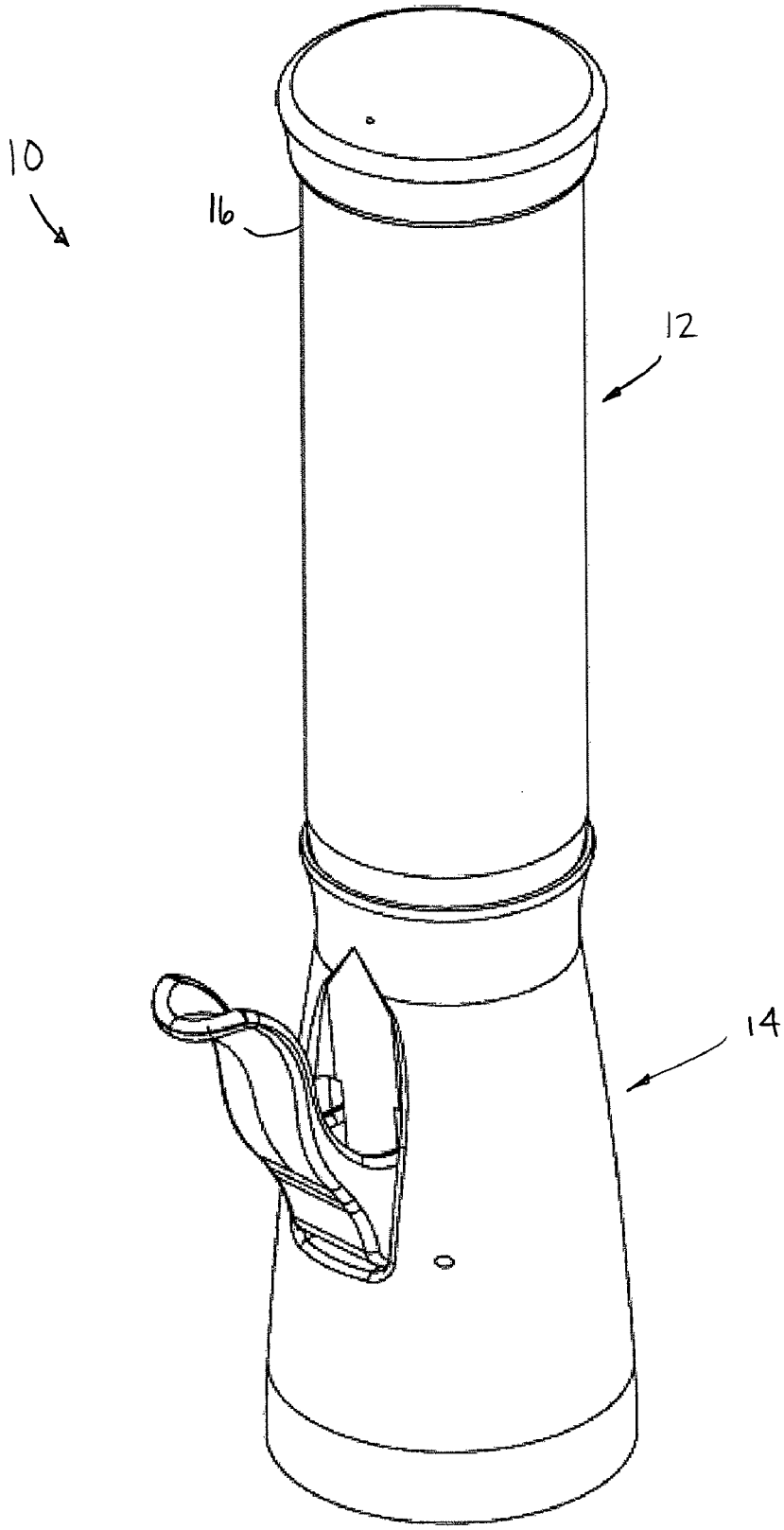
FIG. 1 is an isometric view of a dispenser having exemplary features of aspects in accordance with the principles of the present disclosure.
Figure 2:
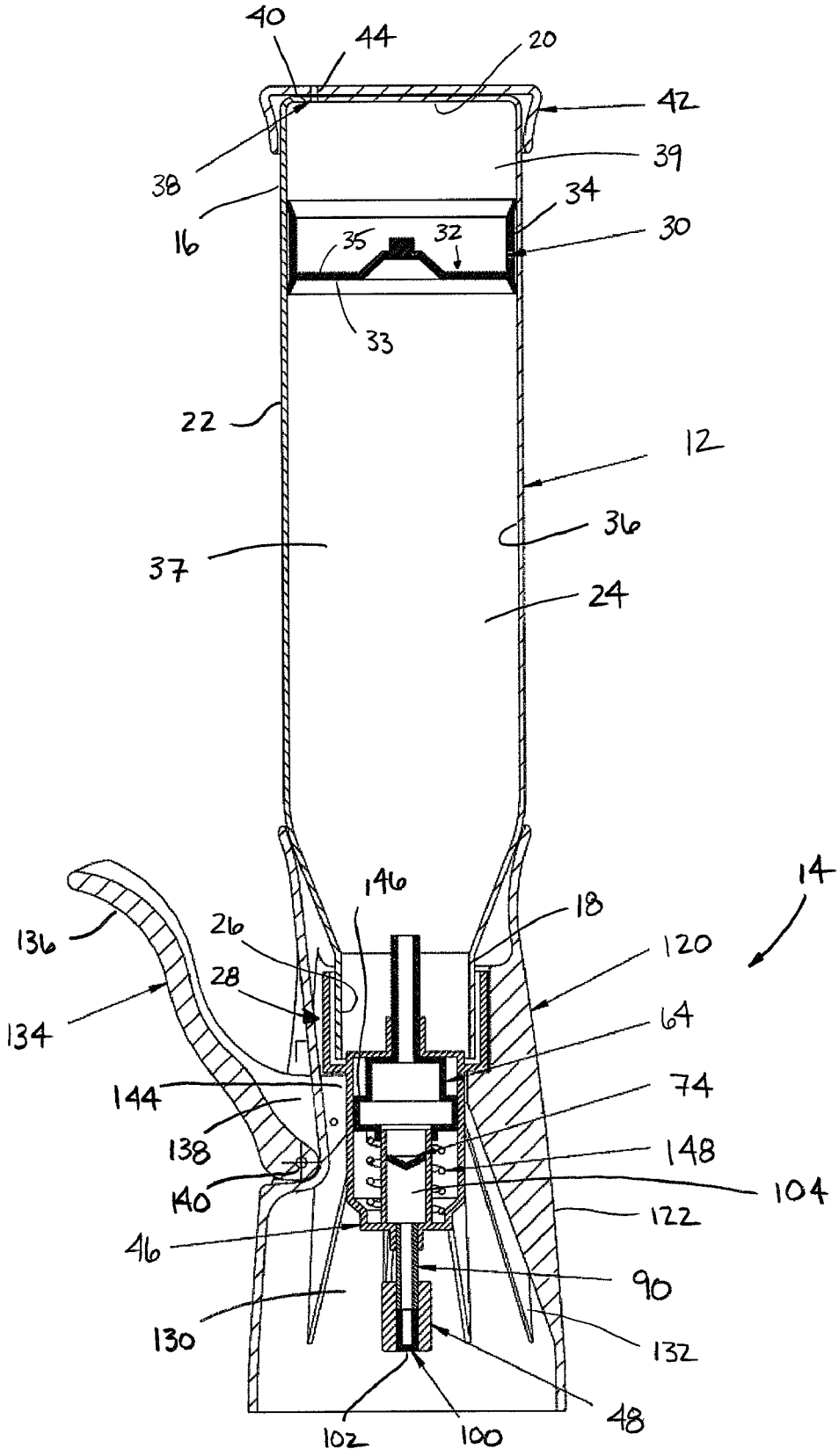
FIG. 2 is a cross-sectional view of the dispenser of FIG. 1.

Referring now to FIGS. 1 and 2, a dispenser, generally designated 10, for use with non-aerosol fluids will be described. The dispenser 10 includes a container, generally designated 12, and a dispensing device, generally designated 14.

The container 12 includes a first end portion 16 and a second end portion 18. The second end portion 18 of the container 12 tapers down to an outer diameter that is less than an outer diameter of the first end portion 16. It will be understood, however, that the scope of the present disclosure is not limited to the second end portion 18 having an outer diameter that is less than the first end portion 16 as the outer diameter of the first end portion 16 can be less than or equal to the second end portion 18.

The container 12 includes an end wall 20, which is disposed at the first end portion 16, and a sidewall 22, which is disposed about the periphery of the end wall 20. The sidewall 22 extends outwardly from the end wall 20. In the depicted example, the end wall 20 and the sidewall 22 are monolithic.

The end wall 20 and the sidewall 22 of the container 12 define an interior cavity 24 (shown in FIG. 2) having an opening 26 at the second end portion 18. In the depicted example, the opening 26 is disposed below the end wall 20 such that the container 12 is inverted. It will be understood, however, that the scope of the present disclosure is not limited to the container 12 being inverted.

A valve mechanism, generally designated 28, is disposed in the opening 26 of the interior cavity 24. The interior cavity 24 of the container 12 and the valve mechanism 28 can be adapted to contain non-aerosol products (e.g., cooking oils, gels, etc.). In order to contain these products, the container 12 can be manufactured from natural or synthetic materials such as aluminum, stainless steel, or various plastics such as polyethylene terephthalate (PET), polytetrafluoroethylene (PTE), polyethylene Naphthalate (PEN), high-density polyethylene, and combinations thereof.

In the depicted example of FIGS. 1 and 2, the interior cavity 24 of the container 12 includes a plunger, generally designated 30. The plunger 30 includes a base, generally designated 32, having a first side 33 and a second side 35. The plunger 30 further includes a side 34 that extends outwardly from the periphery of the base 32. The side 34 of the plunger 30 is adapted for sealing engagement with an inner wall 36 of the interior cavity 24. The first side 33 of the base 32 of the plunger 30 and the interior cavity 24 cooperatively define a product cavity 37 that is disposed between the plunger 30 and the valve mechanism 28. The second side 35 of the base 32 and the interior cavity 24 cooperatively define an air cavity 39. The non-aerosol product (e.g., cooking oil, gel, etc.) is disposed in a product cavity 37 while air is disposed in an air cavity 39.

The plunger 30 keeps the product cavity 37 and the air cavity 39 separate. This separation of the product in the product cavity 37 from air in the air cavity 39 protects the product stored in the container 12 from exposure to moisture and oxygen. As interactions between the product and moisture and oxygen in the air can form precipitates or can change the fluid viscosity of the product, the plunger 30 provides consistent and repeatable spray characteristics of the dispenser 10 throughout its use and provides a consistent product contained in the dispenser 10 throughout its use. As the plunger 30 protects the product against oxidation and hydration, the use of preservatives such as antioxidants in food related products may be decreased. Therefore, the plunger 30 is potentially advantageous as it provides a cost effective way of keeping the product separate from air. In addition, the plunger 30 allows the product to be seen through a transparent or translucent container 12 so that a consumer can determine the level of product remaining in the container 12.

As the axial position of the plunger 30 changes, air passes into or out of the air cavity 39 through a vent 38 defined by the end wall 20 of the container 12. The size of the vent 38 is dependent upon the velocity of the plunger 30 in the interior cavity 24. In the depicted example shown in FIG. 2, the vent 38 is disposed in an outer edge portion 40 of the end wall 20. It will be understood, however, that the scope of the present disclosure is not limited to the vent 38 being disposed in an outer edge portion 40 of the end wall 20.

In the depicted example, the container 12 includes an over-cap 42. The over-cap 42 is inserted over the first end portion 16 of the container 12 such that a hole 44 defined in the over-cap 42 is aligned with the vent 38 of the end wall 20. In one example, the over-cap 42 is in friction-fit engagement with the first end portion 16 of the container 12. In another example, the over-cap 42 is bonded to the first end portion 16 with an adhesive.

Figure 3:
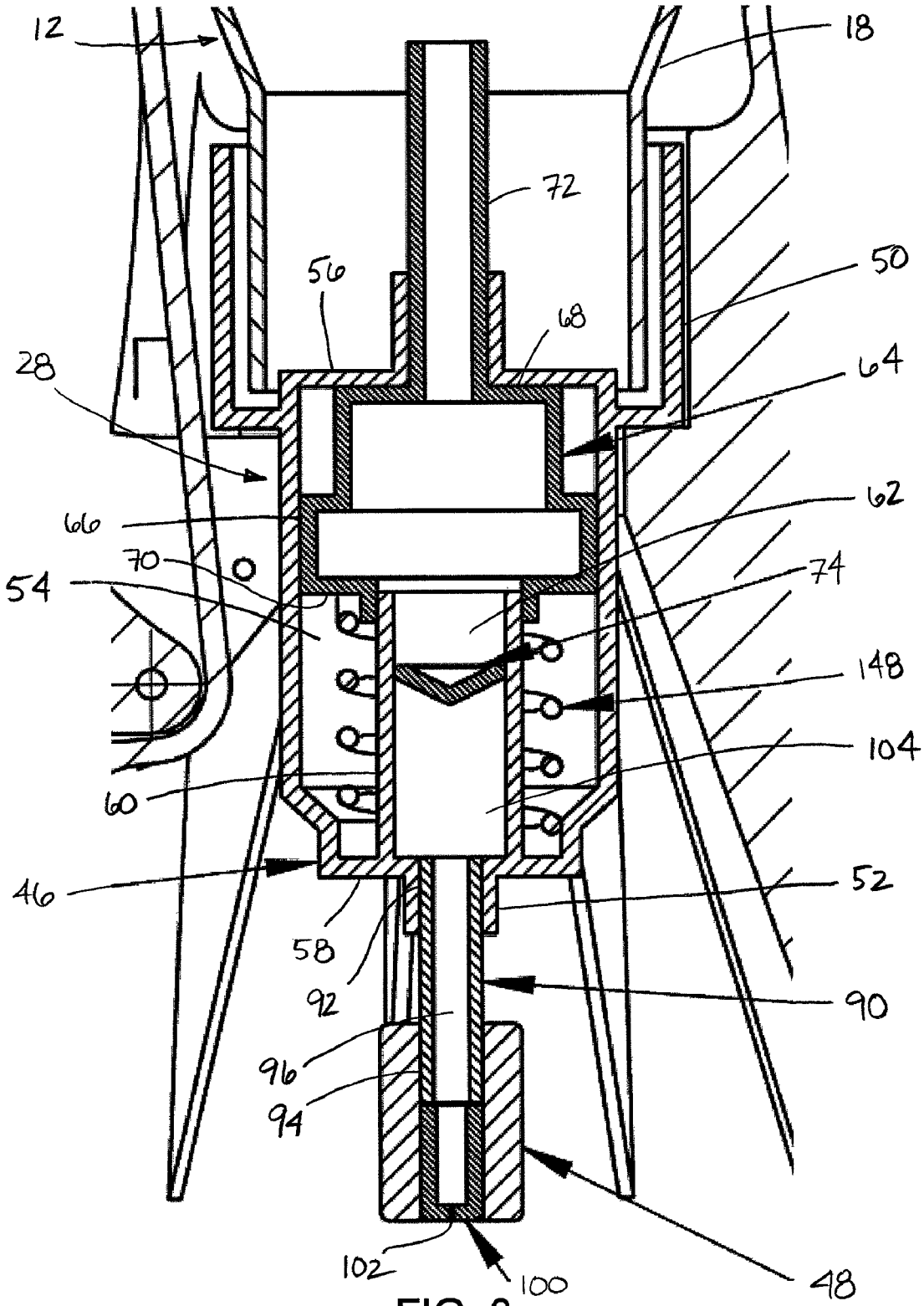
FIG. 3 is an enlarged cross-sectional view of a valve mechanism that is suitable for use in the dispenser of FIG. 1.

Referring now to FIG. 3, the valve mechanism 28 includes an accumulator, generally designated 46, and a nozzle, generally designated 48. The accumulator 46 includes a container portion 50 and an oppositely disposed nozzle portion 52.

The container portion 50 of the accumulator 46 is engaged with the second end portion 18 of the container 12. In one example, the container portion 50 is threadedly engaged with the second end portion 18 of the container 12. In another example, the container portion 50 is in snap-fit engagement with the second end portion 18 of the container 12. In another example, the container portion 50 is bonded to the second end portion 18 of the container 12.

The accumulator 46 further includes a pumping chamber 54 disposed between the container portion 50 and the nozzle portion 52. The pumping chamber 54 includes a container end 56 and an oppositely disposed nozzle end 58. In the depicted example, a cylindrical wall 60 extends outwardly from the nozzle end 58 toward the container end 56 and defines an axial opening 62 in fluid communication with the container portion 50 and the nozzle portion 52 of the accumulator 46.

A piston, generally designated 64, is disposed in the pumping chamber 54 of the accumulator 46. In the depicted embodiment, the piston 64 is selectively slidable in the pumping chamber 54. The piston 64 includes a body, generally designated 66, having a first end 68, which faces toward the container end 56, and a second end 70, which faces toward the nozzle end 58. A stem portion 72 extends outwardly from the first end 68 of the body 66 while a valve portion 74 extends outwardly from the second end 70. The stem portion 72 defines a bore 76 that extends into a cavity 78 defined by the body 66. The valve portion 74 of the piston 64 is a one-way valve that is biased to a closed position. While the one-way valve 74 is disposed on the piston 64 in the depicted embodiment, it will be understood that the scope of the present disclosure is not limited to the one-way valve 74 being disposed in the piston 64 as the one-way valve 74 could be disposed in an alternate location in the accumulator 46 or in the second end portion 18 of the container 12.

The nozzle portion 52 of the accumulator 46 is engaged with a nozzle tube, generally designated 90. The nozzle tube 90 includes a first axial end 92 and an oppositely disposed second axial end 94 and defines a central opening 96 through the first and second axial ends 92, 94. The first axial end 92 of the nozzle tube 90 is in engagement with the nozzle portion 52 of the accumulator 46. In one example, the nozzle portion 52 is threadedly engaged with the first axial end 92 of the nozzle tube 90. In another example, the nozzle portion 52 is bonded to the first axial end 92 of the nozzle tube 90. In another example, the nozzle tube 90 is in press-fit engagement with the first axial end 92 of the nozzle tube 90.

The nozzle 48 is engaged with the second axial end 94 of the nozzle tube 90. In the depicted example, the nozzle 48 includes an insert 100 that defines an orifice 102. A pressure chamber 104, which is disposed between the valve portion 74 of the piston 64 and the orifice 102 of the nozzle 48, is cooperatively defined by the cylindrical wall 60 of the accumulator 46, the nozzle tube 90, and the nozzle 48.

Figure 4:
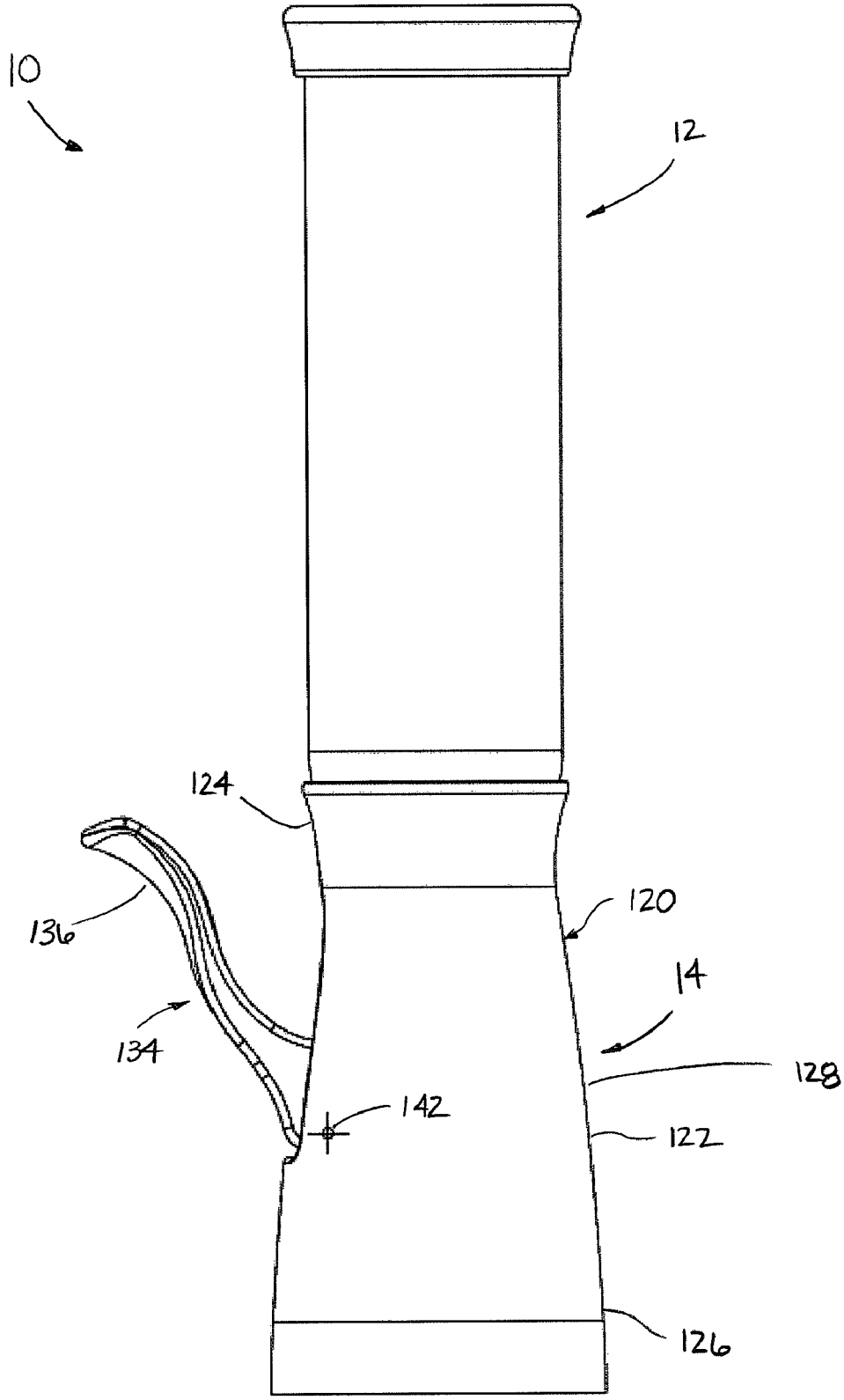
FIG. 4 is a side view of the dispenser of FIG. 1.

Referring now to FIGS. 1, 2, and 4, the dispensing device 14 will be described. The dispensing device 14 includes a housing, generally designated 120. The housing 120 includes a sidewall 122 having a first axial end portion 124, a second axial end portion 126, and a mid-portion 128 disposed between the first and second axial end portions 124, 126. In the depicted example shown in FIGS. 1-3, an outer diameter of the second axial end portion 126 is greater than an outer diameter of the first axial end portion 124. While the scope of the present disclosure is not limited to such a configuration, the larger outer diameter of the second axial end portion 126 would provide for greater stability of the dispenser 10 when the dispenser 10 is resting on the second axial end portion 126. In the depicted example, the second axial end portion 126 tapers toward the mid-portion 128. While the scope of the present disclosure is not limited to such a configuration, the tapering of the second axial end portion 126 toward the mid-portion 128 may provide for a more ergonomic gripping location.

The housing 120 defines a central cavity 130 (shown in FIG. 2) that extends through the first and second axial end portions 124, 126. The central cavity 130 includes a plurality of ribs 132 (shown in FIG. 2) that provide support for the housing 120 and provide an engagement location for the accumulator 46. In the depicted example, the container portion 50 of the accumulator 46 is in engagement (e.g., press-fit, snap-fit, bonded, threaded, etc.) with the ribs 132 such that the container 12 extends outwardly from the first axial end portion 124 of the housing 120.

The dispensing device 14 further includes an actuator, generally designated 134. In the depicted example, the actuator 134 is pivotally engaged with the sidewall 122 of the housing 120. It will be understood, however, that the scope of the present disclosure is not limited to the actuator 134 being pivotally engaged with the sidewall 122.

The actuator 134 includes a handle portion 136 and an actuation portion 138. In the depicted example, the handle portion 136 defines a pivot opening 140. The pivot opening 140 is adapted to receive a pin that is inserted through pin openings 142 in the sidewall 122 of the housing 120 and through the pivot opening 140 in the actuator 134. An outer diameter of the pin is slightly smaller than the inner diameter of the pivot opening 140 in the actuator 134 which allows for the actuator 134 to pivot about the pin between a released position (shown in FIG. 2) and an actuated position.

The actuation portion 138 of the actuator 134 extends through the sidewall 122 of the housing 120 and through an exterior of the accumulator 46. An end 144 of the actuator portion 138 engages a shoulder 146 disposed on the body 66 of the piston 64. As the actuator 134 is pivoted about the pin toward the housing 120, the end 144 of the actuator portion 138 displaces the piston 64 downwardly toward the nozzle 48. When the actuator 134 is released, a spring 148 that is disposed in the pumping chamber 54 of the accumulator 46 biases the piston 64 in an upward direction, which pivots the actuator 134 about the pin to the released position.

Referring now to FIGS. 2 and 3, the dispensing of the product contained in the dispenser 10 will be described. As previously stated, the product is disposed in the container 12 between the plunger 30 and valve mechanism 28. In addition, after the first actuation of the actuator 134, product is disposed in the pressure chamber 104. As the handle portion 136 of the actuator 134 is moved to the actuated position, the piston 64 is displaced downwardly toward the nozzle end 58 of the pumping chamber 54 of the accumulator 46. As the piston 64 is displaced downwardly, the valve portion 74 of the piston 64 compresses the product disposed in the pressure chamber 104, which increases the fluid pressure of the product. The fluid pressure of the product increases until a desired fluid pressure is reached at which point the product is dispensed from the orifice 102 of the nozzle 48. When the handle portion 136 is released, the spring 148 biases the piston 64 upwardly toward the container end 56 of the pumping chamber 54 of the accumulator 46. As the piston 64 is biased toward the container end 56 of the pumping chamber 54, a slight vacuum is created in the pressure chamber 104. This slight vacuum causes the valve portion 74 to open and product from the container 12 to be drawn into the pressure chamber 104.

As product is drawn into the pressure chamber 104, the product volume in the container 12 decreases. As the product volume decreases, the plunger 30, which is disposed in the container 12, is pulled downwardly toward the second end portion 18 of the container 12 by suction. As the plunger 30 is pulled downwardly, air enters the air cavity 39 in the container 12 through the vent 38 in the end wall 20.

Figure 5:
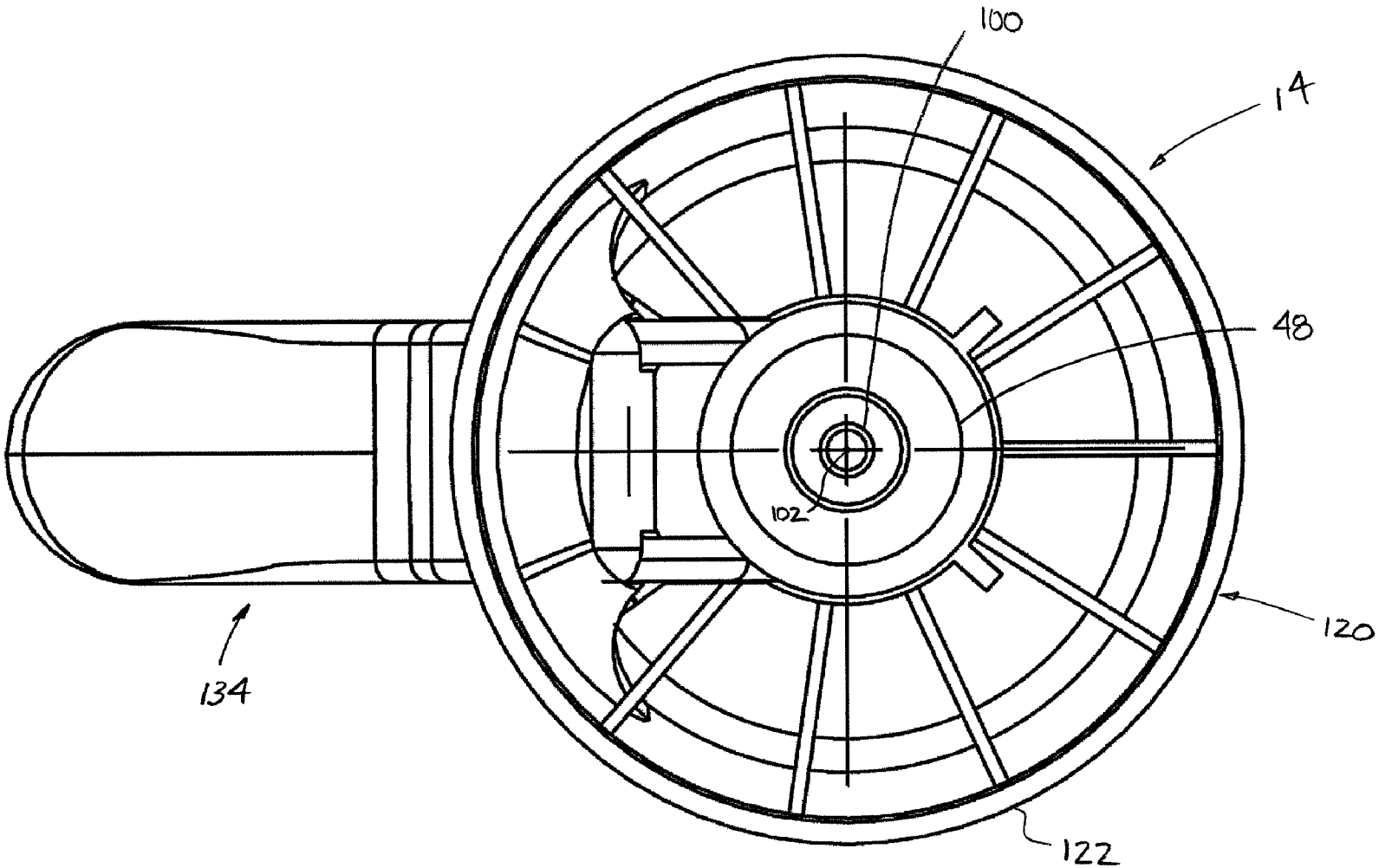
FIG. 5 is a bottom view of the dispenser of FIG. 1.

Referring now to FIGS. 3 and 5, the orifice 102 of the nozzle 48 is sized such that the desired spray characteristics of the dispenser can be achieved at the fluid pressure created in the pressure chamber 104 by the actuation of the piston 64. The spray characteristic is a function of orifice area, the fluid pressure of the product in the pressure chamber 104 immediately prior to dispensing, and the fluid viscosity of the product.

The size of the orifice 102 of the nozzle 48 is chosen based on fluid pressure and fluid viscosity. In one example, the size of the orifice 102 of the nozzle 48 is based on the fluid pressure of the product in the pressure chamber 104 immediately prior to product dispensing being about 80 psi to about 120 psi, about 90 psi to about 110 psi, or about 100 psi.

As previously stated, the container 12 can be adapted to contain various liquids, gels, and gases. However, it is particularly advantageous when used with liquids such as non-propellant cooking spray compositions. Non-propellant cooking spray compositions for use in the dispenser 10 and methods for preparing the cooking spray compositions will now be described.

The cooking spray compositions are capable of facilitating the release of foodstuffs from cookware and cooking utensils. The non-propellant cooking spray compositions have a viscosity of about 25 centipoise (cPs) to about 45 cPs and comprise an edible oil or mixture of edible oils, a pan release agent, and a thinning agent. The non-propellant compositions can optionally include one or more preservatives, flavorings, and/or colorants. The cooking spray composition is generally transparent or translucent and substantially free of foam.

Any edible oil or mixture or blend of edible oils can be used in the compositions. The edible oil can be a vegetable oil, animal oil, or nut oil. Such oils include, but are not limited to, canola, partially hydrogenated winterized canola, corn, coconut, palm, sesame, olive, peanut, cottonseed, safflower, soy, partially hydrogenated winterized soy, sunflower, almond, cashew, hazelnut, macadamia, pecan, pistachio, walnut, grape seed, pumpkin seed, watermelon seed, fish, and rice bran oils. The edible oil can be extracted from animal or plant tissues, fruits, or seeds using conventional methods.

As used herein, the terms "percent by weight" and "% by weight" used with reference to a particular component means the weight of that component in the composition divided by the total weight of the composition, including that of the particular component, with the result multiplied by 100. The edible oil component of the non-propellant cooking spray compositions constitutes by percentage the largest component by weight of the composition and serves as a vehicle for the pan release agent and any other ingredients. The edible oil or mixture thereof comprises about 60% to about 99%, about 65% to about 99%, about 70% to about 99%, about 75% to about 99%, about 76% to about 99%, about 77% to about 99%, about 78% to about 99%, about 79% to about 99%, about 80% to about 99%, about 85% to about 99%, about 90% to about 99%, about 95% to about 99%, about 96% to about 99%, about 97% to about 99%, or about 98% to about 99% by weight of the cooking spray composition. In some of the compositions, the edible oil comprises about 60% to about 90%, about 70% to about 90%, about 75% to about 90%, about 76% to about 90%, about 77% to about 90%, about 78% to about 90%, about 79% to about 90%, about 80% to about 90%, or about 85% to about 90% by weight of the cooking spray composition. In some of the compositions, the edible oil comprises about 70% to about 80%, about 75% to about 80%, about 76% to about 80%, about 77% to about 80%, about 78% to about 80%, or about 79% to about 80%, or by weight of the composition. In some of the compositions, the edible oil comprises, about 70%, about 71%, about 72%, about 73%, about 74%, about 75%, about 76%, about 77%, about 78%, about 79%, about 80%, about 81% about 82%, about 83%, about 84%, about 85%, about 86%, about 87%, about 88%, about 89%, about 90%, about 91%, about 92%, about 93%, about 94%, about 95%, about 96%, about 97%, about 98%, or about 99% be weight of the composition.

The pan releasing agent of the non-propellant cooking spray compositions comprises lecithin, phosphated monoglycerides, phosphated diglycerides, a lecithin replacer such as NU-RICE® (Ribus, St. Louis, Mo.), or a combination thereof. Any lecithin, including commercially available standard lecithins, modified lecithins and combinations thereof, may be used in the composition. As used herein, the term "standard lecithin" means any lecithin whether crude, refined, filtered, and/or bleached wherein the lecithin, or at least the phosphatide content thereof, is not chemically modified by reaction of its functional groups. As used herein, "modified lecithin" mean chemically modified lecithins, such as acetylated and hydroxylated lecithins.

Any phosphated monoglyceride and/or diglyceride may be used alone or in combination in the composition. Phosphated monoglycerides and phosphated diglycerides are commercially available, for example, from Lambent Technologies (Gurnee, Ill.) and Magrabar Chemical (Morton Grove, Ill.). Examples of commercially available phosphated monoglycerides and phosphated diglycerides include, but are not limited to, LAMCHEM™ PE-130K, LAMCHEM™ 113 (Lambent Technologies, Gurnee, Ill.), and Phosphoglyceride GPC-10-CSO-LA (Magrabar Chemical, Morton Grove, Ill.).

The pan releasing agent comprises about 1% to about 15%, about 2% to about 15%, bout 3% to about 15%, about 4% to about 15%, about 6% to about 15%, about 7% to about 15%, about 8% to about 15%, about 9% to about 15%, about 10% to about 15%, about 11% to about 15%, about 12% to about 15%, about 13% to about 15%, or about 14% to about 15% by weight of the composition. In some of the compositions, the pan releasing agent comprises 2.5% to about 6%, about 3% to about 6%, about 3.5% to about 6%, about 4% to about 6%, about 4.5% to about 6%, about 5% to about 6% by weight of the cooking spray composition. In some of the compositions, the pan releasing agent comprises about 2% to about 5.5%, about 2.5% to about 5.5%, about 3% to about 5.5%, about 3.5% to about 5.5%, about 4% to about 5.5%, about 4.5% to about 5.5%, or about 5% to about 5.5% by weight of the cooking spray composition. In some of compositions, the pan releasing agent comprises about 2% to about 6%, about 2.5% to about 6% about, 3% to about 6%, about 3.5% to about 6%, about 4% to about 6%, or about 4.5% to about 6%, about 5% to about 6%, or about 5.5% to about 6% by weight of the cooking spray composition. In some of the compositions, the pan releasing agent comprises about 2% to about 3.5%, about 2.5% to about 3.5%, or about 3% to about 3.5% by weight of the cooking spray composition. In some of the compositions, the pan releasing agent comprises about 2% to about 3%, about 2.5% to about 3%, or about 2.75% to about 3% by weight of the cooking spray composition. In some of the compositions, the pan releasing agent comprises about 2%, about 2.1%, about 2.2%, about 2.3%, about 2.4%, about 2.5%, about 2.6%, about 2.7% about, 2.8%, about 2.9%, or about 3% by weight of the cooking spray composition. In some of the compositions, the pan releasing agent comprises about 1%, about 2%, about 3%, about 4%, about 5%, about 6%, about 7%, about 8%, about 9%, about 10%, about 11%, about 12%, about 13%, about 14%, or about 15% by weight of the cooking spray composition. In some of the compositions, the pan releasing agent comprises about 3%, about 3.25%, about 3.5%, about 3.75%, about 4%, about 4.25%, about 4.5%, about 4.75%, about 5%, about 5.25%, about 5.5%, about 5.75%, or about 6% by weight of the cooking spray compositions.

The amount of lecithin is calculated as unhydrated lecithin. Thus the amount of lecithin when expressed as percent by weight of the cooking spray composition is specified independently of water content, whether the water is present as free water, water of hydration, or as both.

The lecithin is generally obtained from soybeans, rice, or egg yolk. The lecithin can be in liquid or powder form. Most commercially available lecithins are made from soybeans and are available both in liquid form or dry powdered form. The liquid form is usually dissolved in soybean oil or other edible oil. Food grade lecithins are typically obtained from soybeans by mixing soybean oil with water, which hydrates the lecithin and renders it substantially insoluble in the soybean oil, thereby permitting centrifugal separation of the hydrated lecithin from the oil. The separated lecithin may be dried to provide a lecithin powder or redissolved in a suitable edible oil to provide the lecithin in liquid form.

Lecithin is a complex mixture of acetone-insoluble phosphatides comprised mostly of phosphatidylcholine and lesser amounts of phosphatidylethanolamine and phosphatidylinositol, and varying amounts of other materials such as triglycerides, fatty acids, and carbohydrates. Commercially available lecithins are available containing the above components in various combinations and proportions, usually containing from about 50 to 65 percent by weight of acetone-insolubles (phosphatides). In liquid form, lecithin is usually dissolved in soybean oil and is available in different viscosities. The lecithin can be bleached or unbleached and filtered or otherwise refined. Bleaching lightens the color of lecithin and is typically carried out using peroxides. Such treatments typically do not chemically alter the phosphatide content of the lecithin.

The lecithin can be chemically modified. Lecithin contains different functional groups that make it reactive in a number of chemical reactions. Chemically modified lecithins include lecithins which have been acetylated, hydroxylated, hydrolyzed, hydrogenated, halogenated, phosphorylated and sulfonated, among other treatments. However, insofar as significant quantities of commercially available chemically modified lecithins are concerned, only acetylated and hydroxylated lecithins are widely commercially available.

The lecithin may contain a small amount of fatty acids. Generally manufacturers of commercial lecithins add small amounts of fatty acids to their products in order to produce end product lecithins that have consistent pH values and/or to control the viscosity of the lecithin. Since lecithins naturally contain varying quantities of fatty acids, the amounts of fatty acids added by the lecithin manufacturers varies as well.

The thinning agent of the non-propellant cooking spray compositions comprises medium chain triglycerides (MCT), ethyl alcohol, or a combination thereof. MCTs are medium chain (e.g., 6 to 12 carbons) fatty acid esters of glycerol. Coconut oil and palm kernel oils are several common sources for MCTs. The medium chain fatty acids (and the corresponding number of carbon atoms) found in MCTs are caproic (C6), caprylic (C8), capric (C10), and lauric acid (C12). MCTs are composed of a glycerol backbone and three of these fatty acids, and are commonly expressed as approximate ratios of these fatty acids. For example, a commercial MCT that can be derived from coconut oil is 2(C6):55(C8):42(C10):1(C12) (see, for example, www.pdrhealth.com/drug_info/nmdrugprofiles/nutsupdrugs/med__0172.html). Any MCT or mixtures thereof can be used in the non-propellant cooking spray compositions. Examples of useful MCTs include, but are not limited to, 1(C6):68(C8):30(C10):1(C12), 56(C8):44(C10), 4(C8):96(C10), 97(C8):3(C10), 1(C6):68(C8):30(C10):1(C12), 6(C6):55.5-85(C8):15-40(C10):4(C12), and 2(C6):55(C8):42(C10):1(C12). Food grade MCTs are commercially available, for example, from Stepan Co. (Northfield, Ill.), Lambent Technologies (Gurnee, Ill.) and Abitec Corp. (Columbus, Ohio). Commercially available MCTs useful in the non-propellant cooking spray compositions described herein include, but are not limited to, CAPTEX® 350 (Abitec Corp., Columbus, Ohio), LUMULSE® CC-33 FKG (Lambent Technologies, Gurnee, Ill.), NEOBEE® 895 (Stepan Co., Northfield, Ill.), NEOBEE® 1053 (Stepan Co., Northfield, Ill.), NEOBEE® 1095 (Stepan Co., Northfield, Ill.), NEOBEE® M-5 (Stepan Co., Northfield, Ill.), and NEOBEE® M-20 (Stepan Co., Northfield, Ill.).

Ethyl alcohol may be included in some of the non-propellant cooking spray compositions as a thinning agent alone or in combination with an MCT. The ethyl alcohol comprises pure grain ethyl alcohol, 160 proof ethyl alcohol, 170 proof ethyl alcohol, 180 proof ethyl alcohol, 190 proof ethyl alcohol, or 200 proof ethyl alcohol.

The amount of thinning agent, particular thinning agent, or mixture of thinning agents utilized in the non-propellant cooking spray compositions is dependent on the desired viscosity of the composition, the viscosity of the edible oil or mixture thereof comprising the composition, and the amount of pan releasing agent in the composition, The thinning agent is added to the cooking spray compositions in an amount sufficient to reduce the viscosity of the compositions to a desired viscosity. The thinning agent is added in an amount sufficient to produce a non-propellant cooking spray composition comprising a viscosity of about 25 centipoise (cPs) to about 45 cPs. Viscosity is determined with a Brookfield Viscometer, Model RVF (Brookfield Engineering, Middleboro, Mass.) at room temperature (e.g., 68-72° F.) with spindle #1 at 20 rpm. In some of the compositions, the viscosity comprises about 25 cPs to about 45 cPs, about 30 cPs to about 40 cPs, or about 32 cPs to about 36 cPs. In some of the compositions, the viscosity comprises about 30 cPs to about 38 cPs, about 30 cPs to about 37 cPs, about 30 cPs to about 36 cPs, about 30 cPs to about 35 cPs, about 30 cPs to about 34 cPs, about 30 cPs to about 33 cPs, or about 30 cPs to about 32 cPs. In some of the compositions, the viscosity comprises about 32 cPs to about 36 cPs, about 33 cPs to about 36 cPs, about 34 cPs to about 36 cPs, or about 35 cPs to about 36 cPs. In some of the compositions, the viscosity comprises about 36 cPs to about 37 cPs. In some of the compositions, the viscosity comprises about 30 cPs, about 30.5 cPs, about 31 cPs, about 31.5 cPs, about 32 cPs, about 32.5 cPs, about 33 cPs, about 33.5 cPs, about 34 cPs, about 34.5 cPs, about 35 cPs, about 35.5 cPs, about 36 cPs, about 36.5 cPs, or about 37 cPs. In some of the compositions, the viscosity comprises, about 25 cPs, about 26 cPs, about 27 cPs, about 28 cPs, about 29 cPs, about 30 cPs, about 21 cPs, about 32 cPs, about 33 cPs, about 34 cPs, about 35 cPs, about 36 cPs, about 37 cPs, about 38 cPs, about 39 cPs, about 40 cPs, about 41 cPs, about 42 cPs, about 43 cPs, about 44 cPs, or about 45 cPs.

The thinning agent comprises about 0% to about 15% by weight of the non-propellant cooking spray compositions. In some of the compositions, the thinning agent comprises about 5% to about 15%, about 6% to about 15%, about 7% to about 15%, about 8% to about 15%, about 9% to about 15%, about 10% to about 15%, about 11% to about 15%, or about 12% to about 15% by weight of the composition. In some of the compositions, the thinning agent comprises about 10% to about 13%, about 10.5% to about 13%, about 11% to about 13%, about 11.5% to about 13%, about 12% to 13%, or 12.5% to about 13% by weight of the composition. In some of the compositions, the thinning agent comprises about 12%, about 12.1%, about 12.2%, about 12.3%, about 12.4%, about 12.5%, about 12.6%, about 12.7%, about 12.8%, about 12.9%, or about 13% by weight of the composition.

The non-propellant cooking spray compositions optionally include one or more preservatives, flavorings, or colorants. One or more preservatives may be included in the compositions. The one or more preservatives are preferably FDA approved for food products. The preservative is preferably an antioxidant. Examples of suitable preservatives include, but are not limited to, propyl gallate, butylated hydroxyanisole, tertiary butylhydroxyquinone, tocopherol, and plant extracts comprising one or more natural antioxidants. Typically, the one or more preservatives comprises about 0.01% to about 0.1% by weight of the composition.

If a particular color is desired for the non-propellant cooking spray compositions, one or more colorants may be added. Preferably the colorants are FDA approved for food products. Examples of suitable colorants include, but are not limited to, annatto and beta-carotene. Typically, a small quantity of the colorants is required, with a range of about 5 to about 10 parts per million being sufficient.

If a particular flavor is desired for the non-propellant cooking spray compositions, one or more flavorings may be added. Preferably the flavorings are concentrated. The flavorings may be in liquid form or dry form. Examples of flavorings include, but are not limited to, butter flavor, garlic flavor, smoke flavor including but not limited to mesquite flavor and hickory flavor, and Italian herb flavor. Typically, the one or more flavorings comprises about 0.01% to about 2% by weight of the composition.

Methods for preparing the non-propellant cooking spray compositions described herein are also provided. The methods include adding lecithin heated to about 100° F. to about 140° F. to a mixing tank containing an edible oil or mixture of edible oils and mixing the oil and lecithin. The mixing tank contains a conventional motor-driven stirrer, such as a variable speed mixer or "Lightnin" type agitator. The MCT and the ethyl alcohol (if desired) is added to the oil and lecithin mixture while maintaining moderate non-aerating agitation and the composition is mixed until homogenous, the composition should be a uniform dispersion with no striations. To prevent separation, the agitation can be reduced from vigorous to a slow, continuous, non-aerating agitation until the composition is placed into the dispenser. Preparation of the compositions is generally carried out at ambient temperatures, generally about 68° F. to about 90° F. In some cases, depending on the particular formulation employed, continued or periodic mixing may be necessary to insure that all ingredients remain uniformly suspended and dispersed in the composition.

The following examples are provided for illustrative purposes only, and are in no way intended to limit the scope of the present application. All references in the Tables and Examples to "%" or "percent" mean percent by weight as defined above, unless specifically noted otherwise.

EXAMPLE 1

Non-propellant cooking spray compositions in accordance with the present application were prepared to illustrate the operability of the compositions. The compositions were produced as described above. Briefly, lecithin (50-54% by weight in vegetable oil—Kosher) was heated to about 100° F. to about 140° F. and added to a mixing tank containing canola oil. The mixing tank contained a variable speed mixer and a tight fitting lid to prevent absorption of moisture. The canola oil and lecithin were mixed using moderate, non-aerating agitation at ambient temperature. The MCT (NEOBEE® 895; Stepan Co., Northfield, Ill.) and ethyl alcohol (pure 200 proof ethyl alcohol) was added to the oil and lecithin mixture while maintaining moderate non-aerating agitation and the composition was mixed at ambient temperature until homogenous. To prevent separation, agitation was reduced from vigorous to a slow, continuous, non-aerating agitation until the composition was placed into the dispenser. Formulations of the non-propellant cooking spray compositions that were prepared are shown in Table 1.

TABLE 1

| Formula | % Canola Oil | % MCT | % Ethanol | % Lecithin | Viscosity (cPs) |
|---|---|---|---|---|---|
| 1 | 80 | 12.5 | 5.0 | 2.5 | 36.5 |
| 2 | 77.3 | 12.7 | 5.0 | 5.0 | 35.0 |
| 3 | 90 | 5.0 | 2.5 | 2.5 | 48.0 |
| 4 | 60 | 25 | 10 | 5 | 31.0 |
| 5 | 45 | 50 | 10 | 5 | 36.0 |

Viscosity of the cooking spray compositions was determined with a Brookfield Viscometer, Model RVF (Brookfield Engineering, Middleboro, Mass.) at room temperature (e.g., 68-72° F.) with spindle #1 at 20 rpm.

As previously stated, the size of the orifice 102 of the nozzle 48 is a function of the fluid viscosity of the product. In the subject example, the size of the orifice 102 of the nozzle 48 is a function of the percentage by weight of thinning agent. As the amount of thinning agent is increased in the cooking spray composition, the viscosity decreases which allows for a smaller size orifice 102 for a given fluid pressure.

Although the subject matter has been described in language specific to structural features, compositions, and/or methodological acts, it is to be understood that the subject matter defined in the appended claims is not necessarily limited to the specific features, compositions, or acts described above. Rather, the specific features, compositions, and acts described above are disclosed as example forms of implementing the claims.

What is claimed is:

1. A dispenser comprising:

a housing having a sidewall with a first axial end and a second axial end;

a container having a first end portion and a second end portion, the second end portion of the container being engaged with the housing such that the container extends from the first axial end of the housing, wherein the container defines an interior cavity adapted for containing a product;

a plunger disposed in the interior cavity of the container, the plunger including a base having a first side and a second side, wherein the interior cavity of the container and the first side of the base cooperatively define a product cavity and the interior cavity of the container and the second side of the base cooperatively define an air cavity;

a valve mechanism in engagement with the second end portion of the container, wherein the valve mechanism includes a nozzle defining an orifice and an accumulator defining a pumping chamber, the nozzle and accumulator cooperatively defining a pressure chamber, the pressure chamber being adapted to receive a portion of the product from the product cavity of the container; and a piston selectively slidable within the pumping chamber, the piston being disposed between the product cavity and the pressure chamber, wherein displacement of the piston in one direction within the pumping chamber causes a portion of the piston to compress the portion of the product in the pressure chamber, thereby increasing a fluid pressure of the portion of the product in the pressure chamber to a target fluid pressure for causing the portion of the product to be expelled from the dispenser via the orifice defined by the nozzle, wherein the pressure chamber is disposed between the piston and the orifice defined by the nozzle.

2. A dispenser as claimed in claim 1, further comprising an actuator pivotally engaged with a sidewall of the housing, wherein the actuator selectively displaces the piston in the pumping chamber of the valve mechanism.

3. A dispenser as claimed in claim 1, wherein the container is translucent.

4. A dispenser as claimed in claim 1, wherein the target fluid pressure is in the range of about 80 psi to about 120 psi.

5. A dispenser according to claim 1, wherein the product is a non-propellant cooking spray composition comprising an edible oil or mixture of edible oils, a pan release agent, and a thinning agent, wherein the composition comprises by weight about 60% to about 99% edible oil or mixture of edible oils, about 0% to about 15% thinning agent, and about 1% to about 15% pan release agent.

6. The dispenser of claim 5, wherein the edible oil comprises a vegetable oil, an animal oil, a nut oil, or a mixture thereof.

7. The dispenser of claim 6, wherein the edible oil comprises one or more of canola, partially hydrogenated winterized canola, corn, coconut, palm, sesame, olive, peanut, cottonseed, safflower, soy, partially hydrogenated winterized soy, sunflower, almond, cashew, hazelnut, macadamia, pecan, pistachio, walnut, grape seed, fish, watermelon see, pumpkin seed, or rice bran oil.

8. The dispenser of claim 5, wherein the edible oil comprises canola oil, cottonseed oil, or a mixture thereof.

9. The dispenser of claim 5, wherein the pan release agent comprises lecithin, phosphated monoglyceride, phosphated diglyceride, lecithin replacer, or a combination thereof.

10. The dispenser of claim 5, wherein the thinning agent comprises medium chain triglycerides (MCT), ethyl alcohol, or a combination thereof.

11. The dispenser of claim 10, wherein the MCT comprises a caproic triglyceride, a caprylic triglyceride, a capric triglyceride, a lauric triglyceride, or a mixture thereof.

12. The dispenser of claim 11, wherein the MCT comprises one or more of 1(C6):68(C8):30(C10):1(C12), 56(C8):44(C10), 4(C8):96(C10), 97(C8):3(C10), 1(C6):68(C8):30(C10):1(C12), or 2(C6):55(C8):42(C10):1(C12).

13. The dispenser of claim 5, wherein the cooking spray composition further comprises one or more colorants, one or more flavorings, and/or one or more preservatives.

14. The dispenser of claim 13, wherein the one or more preservatives comprises an anti-oxidant.

15. The dispenser of claim 13, wherein the composition comprises about 0.01 to about 0.1 parts per million of the one or more preservatives.

16. The dispenser of claim 5, wherein the edible oil comprises canola oil, the thinning agent comprises MCT, and the pan release agent comprises lecithin.

17. The dispenser of claim 5, wherein the cooking spray composition comprises a viscosity of about 25 centipoise (cPs) to about 45 cPs.

18. The dispenser of claim 17, wherein the edible oil comprises canola oil, the thinning agent comprises MCT, and the pan release agent comprises lecithin.

19. The dispenser of claim 18, wherein the edible oil comprises about 80% by weight of the composition, the MCT comprises about 12.5% by weight of the composition, the ethyl alcohol comprises about 2.5% by weight of the composition, and the lecithin comprises about 2.5% by weight of the composition.

20. The dispenser of claim 19, wherein the viscosity comprises about 36.5 cPs.

21. The dispenser of claim 18, wherein the edible oil comprises about 77% by weight of the composition, the MCT comprises about 12.7% by weight of the composition, the ethyl alcohol comprises about 5% by weight of the composition, and the lecithin comprises about 5% by weight of the composition.

22. The dispenser of claim 21, wherein the viscosity comprises about 35 cPs.

23. The dispenser of claim 18, wherein the edible oil comprises about 90% by weight of the composition, the MCT comprises about 5% by weight of the composition, the ethyl alcohol comprises about 2.5% by weight of the composition, and the lecithin comprises about 2.5% by weight of the composition.

24. The dispenser of claim 5, wherein the composition comprises by weight about 77% to about 90% edible oil, about 5% to about 12.7% thinning agent, and about 2.5% to about 5% pan release agent.

25. The dispenser to claim 24, wherein the composition further comprises by weight about 2.5% to about 5% ethyl alcohol.

26. The dispenser of claim 25, wherein the composition comprises a viscosity of about 30 cPs to about 36 cPs.

27. The dispenser of claim 25, wherein the composition comprises a viscosity of about 32 cPs to about 36 cPs.

28. A dispenser comprising:

a housing having a sidewall with a first axial end and a second axial end;

a container having a first end portion and a second end portion, the second end portion of the container being engaged with the housing such that the container extends from the first axial end of the housing, wherein the container defines an interior cavity adapted for containing a product;

a plunger disposed in the interior cavity of the container, the plunger including a base having a first side and a second side, wherein the interior cavity of the container and the first side of the base cooperatively define a product cavity and the interior cavity of the container and the second side of the base cooperatively define an air cavity;

a valve mechanism in engagement with the second end portion of the container, wherein the valve mechanism includes a nozzle defining an orifice and an accumulator defining a pumping chamber, the nozzle and accumulator cooperatively defining a pressure chamber, the pressure chamber being adapted to receive a portion of the product from the product cavity of the container; and a piston selectively slidable within the pumping chamber, the piston being disposed between the product cavity and the pressure chamber, a one-way valve portion being connected to the piston, wherein displacement of the piston in one direction within the pumping chamber causes the one-way valve portion to compress the portion of the product in the pressure chamber, thereby increasing a fluid pressure of the portion of the product in the pressure chamber to a target fluid pressure for causing the portion of the product to be expelled from the dispenser via the orifice defined by the nozzle, the target fluid pressure being in a range of about 80 psi to about 120 psi, wherein the pressure chamber is disposed between the piston and the orifice defined by the nozzle.

29. A dispenser comprising:

a housing having a sidewall with a first axial end and a second axial end;

a container having a first end portion and a second end portion, the second end portion of the container being engaged with the housing such that the container extends from the first axial end of the housing, wherein the container defines an interior cavity adapted for containing a product;

a plunger disposed in the interior cavity of the container, the plunger including a base having a first side and a second side, wherein the interior cavity of the container and the first side of the base cooperatively define a product cavity and the interior cavity of the container and the second side of the base cooperatively define an air cavity;

a valve mechanism in engagement with the second end portion of the container, wherein the valve mechanism includes a nozzle defining an orifice and an accumulator defining a pumping chamber, the nozzle and accumulator cooperatively defining a pressure chamber, the pressure chamber being adapted to receive a portion of the product from the product cavity of the container, the product being a non-propellant product; and a piston selectively slidable within the pumping chamber, the piston being disposed between the product cavity and the pressure chamber, a one-way valve portion being connected to the piston, wherein displacement of the piston in a first direction within the pumping chamber causes a vacuum pressure within the pressure chamber for causing the one-way valve portion to open, thereby causing the portion of the product to be directed from the product cavity into the pressure chamber through the one-way valve portion, and displacement of the piston in a second direction within the pumping chamber causes the one-way valve portion to compress the portion of the product in the pressure chamber to increase a fluid pressure of the portion of the product in the pressure chamber to a target fluid pressure for causing the portion of the product to be expelled from the dispenser via the orifice defined by the nozzle, the target fluid pressure being in a range of about 80 psi to about 120 psi, wherein the pressure chamber is disposed between the one-way valve of the piston and the orifice defined by the nozzle.

* * * * *